US007198451B2

(12) United States Patent
Wimmer

(10) Patent No.: US 7,198,451 B2
(45) Date of Patent: Apr. 3, 2007

(54) QUICK-COUPLER DEVICE

(76) Inventor: Alois Wimmer, 5322 Hof Bei Salzburg, Hof Bei Salzburg (AT)

( * ) Notice: Subject to any disclaimer, the term of this patent is extended or adjusted under 35 U.S.C. 154(b) by 0 days.

(21) Appl. No.: 11/095,863

(22) Filed: Mar. 31, 2005

(65) Prior Publication Data

US 2005/0232742 A1 Oct. 20, 2005

(51) Int. Cl.
*E02F 3/36* (2006.01)

(52) U.S. Cl. ..... 414/723; 37/468

(58) Field of Classification Search ..... 414/723; 37/468

See application file for complete search history.

(56) References Cited

U.S. PATENT DOCUMENTS 4,243,356 A * 1/1981 Takojima ..... 414/723
5,890,871 A * 4/1999 Woerman ..... 414/723
6,487,800 B1 * 12/2002 Evans et al. ..... 37/468

* cited by examiner

*Primary Examiner*—Donald Underwood
(74) *Attorney, Agent, or Firm*—Laurence A Greenberg; Werner H. Stemer; Ralph E. Locher

(57) ABSTRACT

The subject of the patent is a quick-change coupling for attaching work tools to an excavator boom, in which a respective coupling body part (1, 2) is disposed on the work tool and on the excavator boom, the two coupling body parts being mutually securable by a hook connection (3) and a wedge lock (4) having mutual bearing surfaces (5), and at least one coupling plate (14, 14') being respectively provided on the work tool, on both sides of the longitudinal center plane and parallel to the latter, which coupling plates have, congruent with each other, the receiving recesses both of the hook connection (3) and of the wedge connection (4).

14 Claims, 4 Drawing Sheets

QUICK-COUPLER DEVICE

BACKGROUND OF THE INVENTION

Field of the Invention

The invention relates to a quick-change coupling for attaching work tools to an excavator boom, in which a respective coupling body part is disposed on the work tool and on the excavator boom, the two coupling body parts being mutually securable by a hook connection and a wedge lock having mutual bearing surfaces.

In a known configuration of this type, the receiving recesses of the hook connections, and the bearing surface, as well as the wedge lock, are disposed on the work tool in offset arrangement in a plane parallel to the transverse center plane, the hooks of the hook connection being provided symmetrical to the transverse center plane on the work tool and the bearing surface and the wedge lock acting essentially in the region of the transverse center plane. Such a configuration has the drawback that a plurality of different receiving members have to be provided, which, because of the lateral offset one to the other, are subjected to strong bending forces if the work tool is placed under uneven load.

SUMMARY OF THE INVENTION

According to the invention, these stated drawbacks are avoided by the fact that on the work tool, on both sides of the longitudinal center plane and parallel to the latter, there is respectively provided at least one coupling plate, which coupling plates have, congruent with each other, the receiving recesses both of the hook connection and of the wedge connection. The fact that the receiving recesses both for the hook connection and for the wedge connection are provided congruent with each other on either side of the longitudinal center plane means that the forces which arise are imparted evenly to the coupling plates, the coupling plates between the hook connection and the wedge connection being respectively subjected only to tensile load. This is because the hook connection, on the one hand, and the bearing surfaces, on the other hand, are oppositely directed and the wedge connection causes the bearing surfaces to be mutually displaced in such a way that the receiving recess of the wedge connection, in relation to the hook connection, and the bearing surfaces are forced away from each other.

Advantageously, on the excavator boom, on both sides of the plane of inflexion of the boom in the state coupled to the coupling plates, support plates can be provided, running parallel on the tool, for the counterparts which are to be hung or secured in the recesses of the coupling plates. Thus, the transfer of force to the support plates attached to the excavator boom is also realized essentially in respectively one plane, so that these support plates, too, can disperse the imparted forces within the planes of the support plate. The counterpart for the wedge lock can herein be formed by a wedge bar running transversely to the planes of the support plates, which is guided in a track rising obliquely away from the work tool. It is thus easily brought about that, when the wedge member is displaced in the support plates, these are pulled in the direction of the work tool, whereby the corresponding pressing of the bearing surfaces and thus also of the hook connection is obtained. The wedge bar can then pass through the support plates and protrude on those outer sides of the support plates which are facing away from the excavator boom, the wedge profile being provided on both sides of each of the support plates. It is thus possible, with one and the same coupling part attached to the excavator boom, to receive work tools in which the coupling plates are fitted to the work tool either within the support plates, or, indeed, outside of the plate, i.e. distanced further apart. This is achieved in identical manner for the hook connection by the fact that the counterparts for the hook connection are formed by a transverse bar which passes through the support plates and protrudes on those outer sides of the support plates which are facing away from the excavator boom. For the actuation of the wedge bar, a hydraulic piston-cylinder unit can preferably be provided, which, when the wedge lock is unlocked, is fully extended. This has the advantage that the piston area which is available in the locking of the wedge connection, because of the fitted piston rod, is less than for the release of the wedge lock, thereby preventing possible jamming of the wedge connection inasmuch as greater forces can be applied in the release operation than in the locking operation.

In order for the work tools to be able to be fitted both for low-level digging and for high-level digging, i.e. in oppositely directed arrangement, the receiving recesses of the coupling plate can be configured symmetrically in relation to the vertical center plane running transversely to the plane of the plate. Furthermore, on both sides of the longitudinal center plane two coupling plates can respectively be provided, the support plates being able to be inserted into the interspace between the adjacent coupling plates. For larger work tools, in particular, very stable coupling parts can thus be achieved on the work tool. In order to make the forces impact, as far as possible, only upon the connecting members, the hydraulic piston-cylinder unit can be supported, by its end facing away from the wedge bar, against the transverse bar belonging to the hook connection. Finally, for the support of the hydraulic piston-cylinder unit in the direction of fastening of the excavator boom, cranked links are provided, which are prevented from pivoting relative to the support plates. The effect is that the hydraulic piston-cylinder unit is aligned with its longitudinal axis directly in the motional direction of the beam having the wedge surfaces. In order to keep the reciprocally moving parts of the hydraulic piston-cylinder unit free from inadmissible forces, the connection between the hydraulic piston-cylinder unit and the wedge bar can be realized with a reserved clearance.

BRIEF DESCRIPTION OF THE DRAWINGS

Various illustrative embodiments of the subject of the invention are represented in the drawing.

Figure 9:
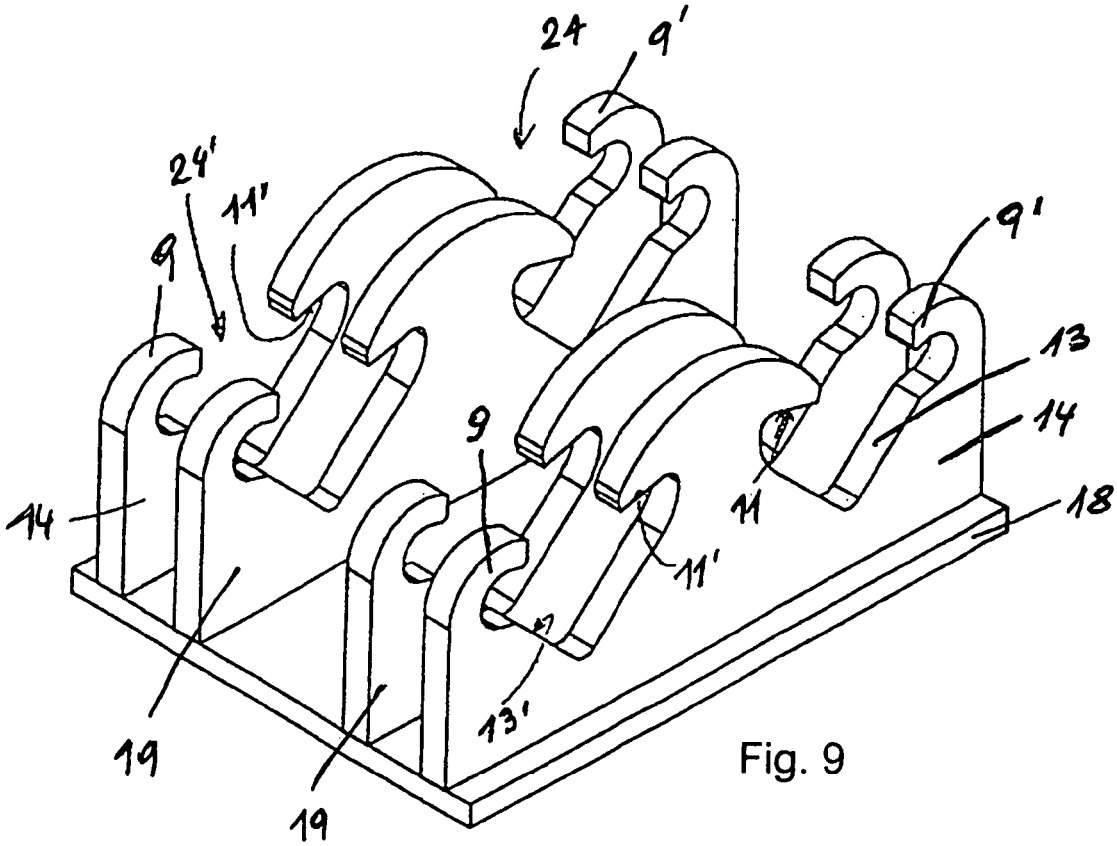
FIG. 9 shows in diagrammatic representation a first embodiment of the coupling part to be fitted to the work tool.
Figure 11:
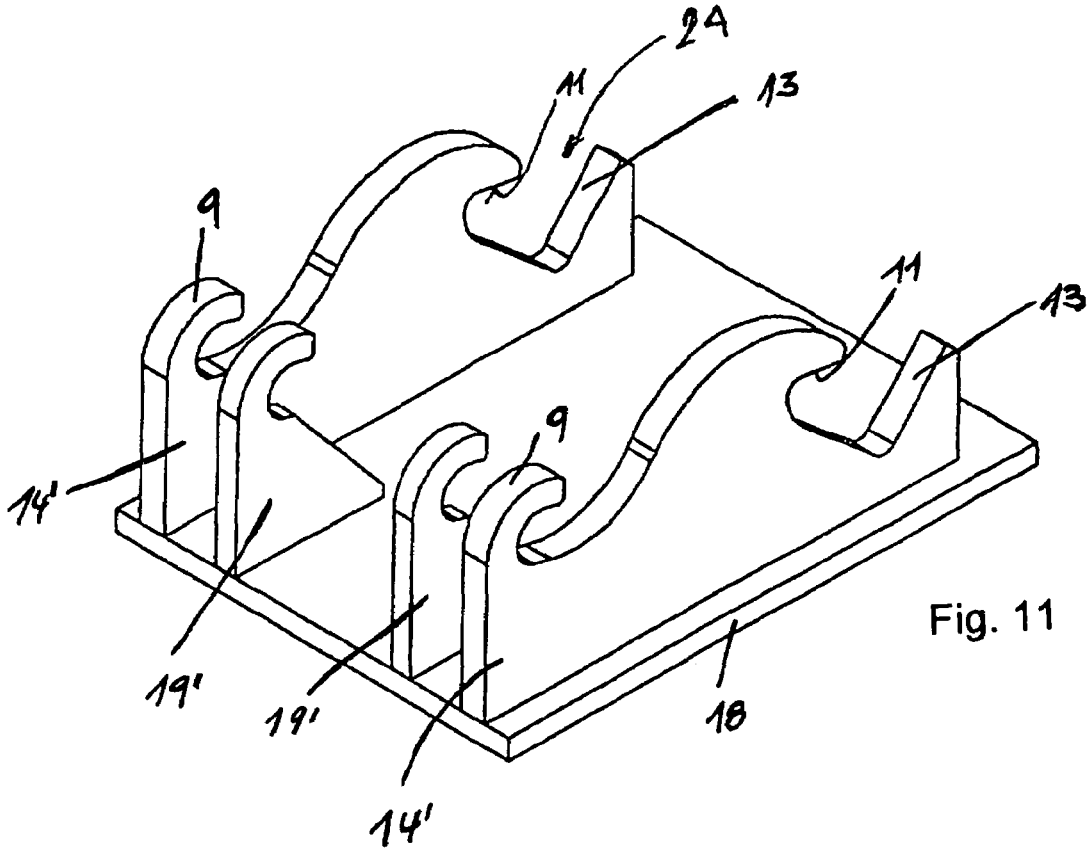
FIG. 11 depicts a further embodiment of the coupling part to be fitted or present on the work tool, in diagrammatic representation.

With respect to the coupling part to be fitted to the work tool, it should further be noted that the coupling parts jutting away from the work tool do not necessarily need to be plurally present on each side, as depicted in FIGS. 9 and 11, but rather it is also sufficient for certain usage variants for the vertical parts to be provided only individually on each side of the longitudinal center, in which case it is possible, according to requirement, for the corresponding vertical portions of the coupling part to be able to be disposed either on the inner sides or, indeed, on the outer sides of the coupling part, which coupling part is sunken relative to the excavator boom.

DESCRIPTION OF THE PREFERRED EMBODIMENTS

The quick-change coupling according to the invention has a coupling part 1 to be attached to the excavator boom, and a coupling part 2 to be attached to the work tool, the two coupling parts being joined together, on the one hand, by a hook connection 3 and, on the other hand, by a wedge connection 4, both coupling parts additionally being provided with mutually interacting, oblique stop-face bearing surfaces 5, which are pressed one against the other by the wedge connection in order to obtain a play-free fit of the two coupling parts.

The coupling part 1 to be attached to the excavator boom has eyelets 6, 7, through which the fastening bolts for the attachment to the excavator boom can be pushed and secured therein.

In order to obtain the hook connection 3, a transverse bar 8, for engagement in the hooks provided on the coupling part 2 to be attached to the work tool, is disposed on the coupling part 1 to be attached to the excavator boom. The wedge connection is formed by a bar 10, which runs parallel to the transverse bar 8 and is truncated in a wedge shape in the region of the wedge connection, as counterfaces on the coupling part 2 stop faces 11 being provided, along which the wedge bar 10 can be moved such that the coupling part 1 is pulled into the coupling part 2. For the mutual securement of the two coupling parts, the mutual bearing surfaces 5 are formed by the provision on the coupling part 1 of a pressure plate 12, which can be brought to bear against corresponding opposing contact surfaces 13 on the coupling part 2. The inclination of the pressure plate 12 roughly corresponds, in the coupled state, to the inclination of the opposing bearing surface 13, so that, when the wedge connection is actuated, a mutual tensioning is obtained between the wedge connection and the bearing surfaces, which tensioning additionally has the effect, due to the inclination of the bearing surfaces 5, of forcing the transverse bar 8 into the hooks 9. For the displacement of the wedge bar 10, a hydraulic piston-cylinder unit 15 is provided, which is arranged such that, for the insertion of the wedge bar 10 on the corresponding opposing wedge surfaces 11, the hydraulic piston-cylinder unit is pressurized in the direction of a shortening of the same. This has the advantage that a higher pressure can be applied for opening purposes than for the insertion of the wedge connection, whereby possible jams can be prevented or such jams can be more easily resolved. For the configuration of the hook 9, of the wedge stop face 11 and of the opposing bearing surface 13, the coupling part 2 to be attached to the work tool is formed by coupling plates 14, 14', which are disposed symmetrically in relation to the longitudinal center plane of the work tool. These coupling plates 14, 14' stand parallel to each other and are attached to a support plate 18. Cross connections for connecting the plates one to another are not provided.

In the case of the coupling part 1 to be attached to the excavator boom, support plates 16 are provided, which, on the one hand, support the eyelets 6, 7 and, on the other hand, support the transverse bar 8 for hanging the coupling part 1 in the hooks 9 of the coupling part 2, the transverse bar 8 joining together the two support plates 16 and jutting beyond these on their outer side on both sides. Furthermore, the two support plates 16, which likewise run parallel to each other and are disposed symmetrically to the longitudinal center plane of the work tool and also to the plane of inflexion of the excavator boom, are further joined together by the pressure plate 12.

Additionally provided between these two support plates 16 is a connecting web 17, which is hung by a middle link 20 from the transverse bar 8 and to which, jutting away therefrom, on the side facing away from the link 12, two mounting links 21 are fitted, between which the hydraulic piston-cylinder unit 15 is pivotably fastened. The connecting link 20, and also the two mounting links 21, are respectively cranked in the direction of the retaining eyelets 6, 7, whereby the longitudinal axis of the hydraulic piston-cylinder unit 15 comes to lie roughly in the motional direction of the wedge bar 10. The wedge bar 10 is guided in the support plates 16 by means of slots 23 and juts over the support plates on both sides on their outer side. The wedge surfaces on the wedge bar 10 are here provided both at the regions located between and adjacent to the support plates 16 and at the regions jutting externally over the support plates 16. The hydraulic piston-cylinder unit 15 engages centrally on the wedge bar 10, the wedge bar 10 being guided in the axial direction by a guide plate 22. As a result of the connection, it is possible for no moments whatsoever to be transmitted to the hydraulic piston-cylinder unit by possible wedge movements, e.g. pivoting about its longitudinal axis. Apart from the pivotable mounting of the hydraulic piston-cylinder unit, this is additionally achieved by the fact that the piston rod is connected to the wedge bar 10 with play and, to be precise, in such a way that, on the one hand, the inner diameter of the eyelet of the piston rod is greater than the outer diameter of the wedge bar 10 (approximately 1 mm difference) and that, on the other hand, the holding plates provided for the axial securement of the eye of the piston rod to the wedge bar are attached to the wedge bar at a distance (approximately 2 mm) from the eyelet. Fitted to these holding plates are the guide plates 22. Thus, if the wedge is slightly slanted, for example, the reciprocally moving parts of the hydraulic piston-cylinder unit are not placed under inadmissible load.

The wedge bar 10 is continuously configured such that it is kept solid, i.e. circular, in the region of the fitting of the hydraulic piston-cylinder unit and is truncated to form a wedge surface on both sides of the connecting link of the hydraulic piston-cylinder unit.

Figure 2:
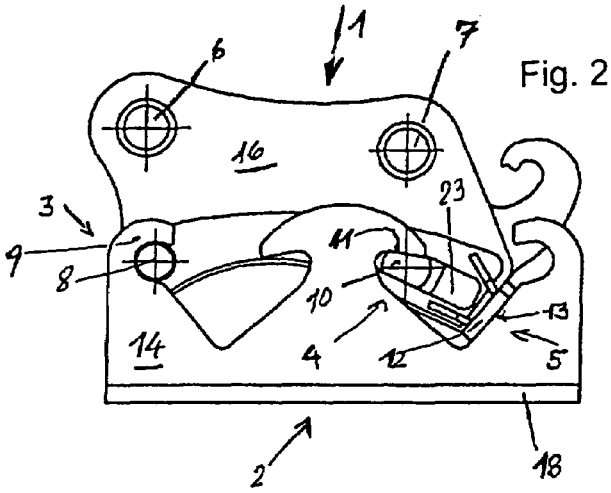
FIG. 2 is a side view.
Figure 3:
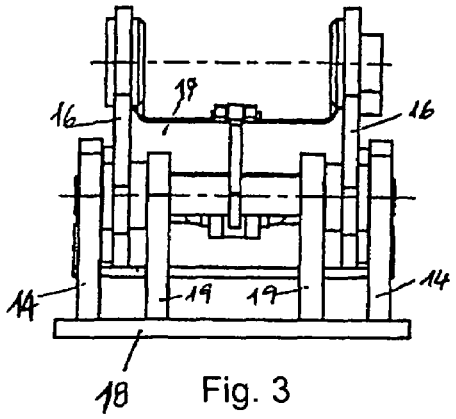
FIG. 3 a front view.
Figure 4:
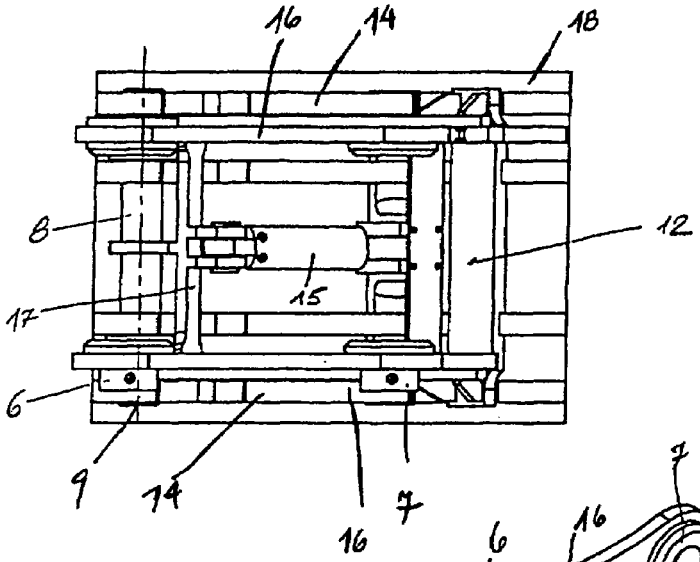
FIG. 4 a top view of the configuration according to FIG. 1. In the representation, both the excavator boom and the work tool are in this case omitted, so as not to complicate the representation.
Figure 1:
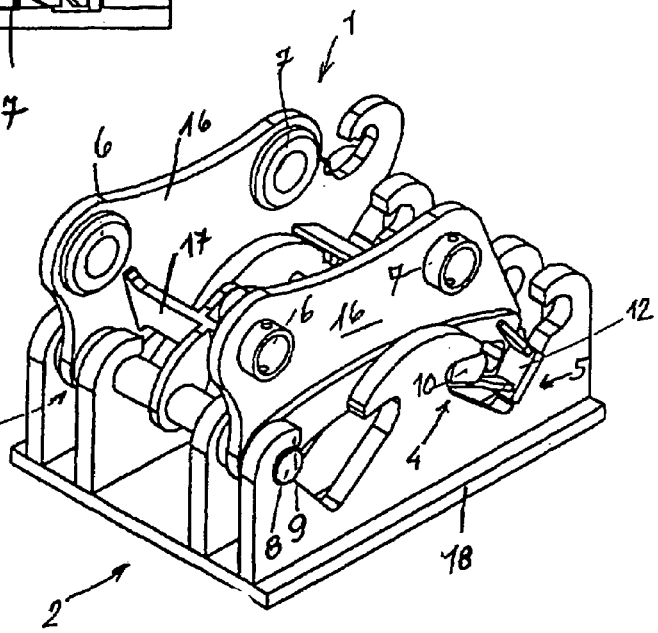
FIG. 1 shows a first embodiment in diagrammatic representation in the coupled state of the two coupling parts.
Figure 5:
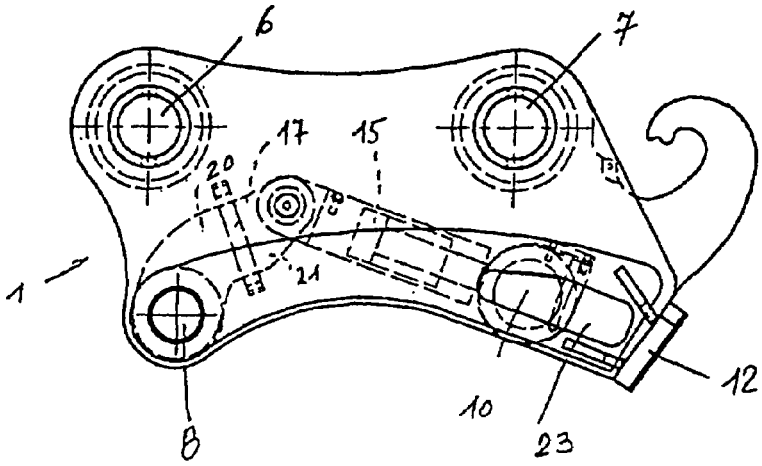
FIG. 5 shows the coupling part to be fitted to the excavator boom alone, without the coupling part present on the work tool, this in side view.
Figure 6:
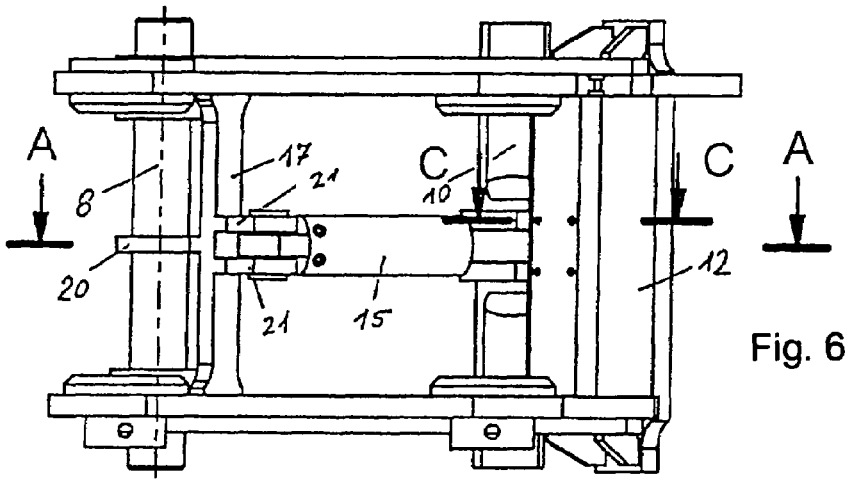
FIG. 6 is a top view of this coupling part.
Figure 7:
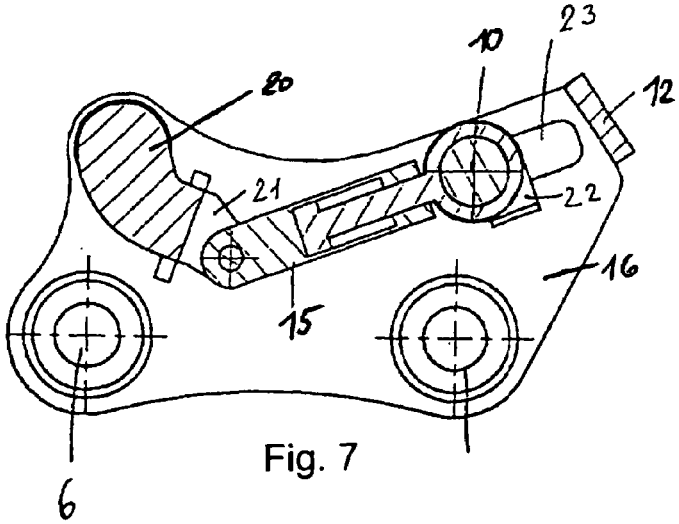
FIG. 7 depicts a section along the line A—A of FIG. 6.
Figure 8:
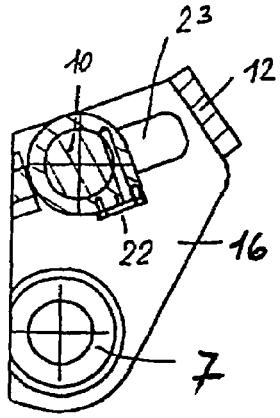
FIG. 8 a section along the line C—C of FIG. 6.
Figure 10:
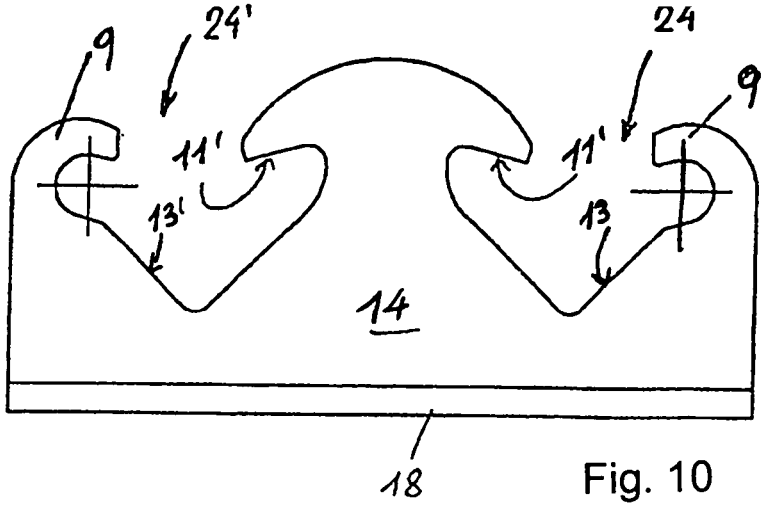
FIG. 10 is a side view of this coupling part represented in FIG. 9.

In the illustrative embodiment of the coupling part 2 to be attached to the work tool, according to FIGS. 9 and 10, this coupling part is configured symmetrically also in relation to the vertical longitudinal center plane of the work tool, i.e. on each coupling plate, a hook 9', directed oppositely to the hook 9, for the hook connection 3, and corresponding oppositely directed counterfaces 11' for the wedge connection 4, and 13' for the bearing contact of the pressure plate 12, are provided. This is designed to allow, for example, an excavator bucket, on the one hand, for low-level operations with the opening downward or, on the other hand, for high-level operations with the opening upward, to be fitted using one and the same coupling tool. According to FIG. 2, in addition to the coupling plates 14, coupling plates 19 are herein provided, which are configured and disposed congruent with the coupling plates 14, the distance between the plates 14 and 19 being dimensioned such that the support plates 16 of the coupling part 1 can engage therebetween. The support plate 14 then engages respectively in those regions of the transverse bar 8, of the wedge bar 10 and of the support plate 12 which are located on the outer sides of the support plate 16, the plates 19 acting upon those regions of the transverse bar 8, of the wedge bar 10 and of the support plate 12 which are located on the inner side of the support plate 16.

Figure 12:
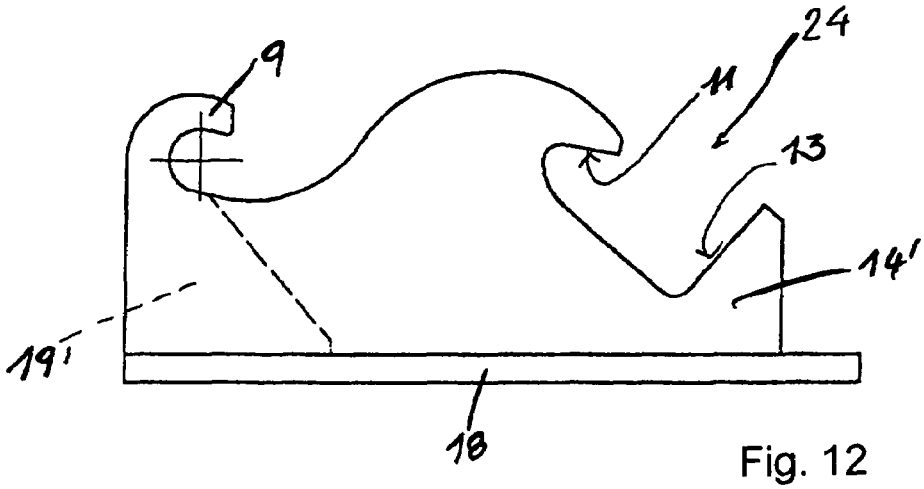
FIG. 12 is an associated side view.

The embodiment according to FIGS. 11 and 12 is designed for simple fitting, i.e. such that the coupling part 2 is non-symmetrical in relation to the longitudinal center plane of the work tool, so that the relevant work tool can only be fitted in a certain direction. Accordingly, each coupling plate 14 of the coupling part 2 has only one hook region 9 and a wedge contact surface 11 and contact surface 13 for the pressure plate 12. The additional hook coupling plates 19' are provided only in the hook region, but not in the region of the wedge connection or pressure plate.

An essential feature of the fast-change coupling according to the invention lies in the fact that the mutual support for the individual parts of the hook connection in relation to the wedge connection runs respectively in mutually parallel planes, so that both the coupling plates 14 and 19 and the support plates 16 are respectively subjected only to tensile load, thereby preventing any bowing or curving of the plates.

Labeled 24 and 24', a free space is respectively provided between the wedge stop face 11 and 11' and the opposing bearing surface 13 and 13', which free space is dimensioned such that the pressure plate 12 can be moved through simultaneously with the fully pushed-back wedge bar 10 in order to bring the pressure plate 12 to bear against the opposing pressure plate 13 and move the wedge bar 10 against the wedge stop face 11.

In order to couple a tool to an excavator boom, the excavator boom with its coupling part 1 is lowered such that the transverse bar 8 engages in the hook 9 of the hook connection 3, after which the pressure plate 12, together with the wedge bar 10, is then lowered, by pivoting of the coupling part 1, through the free interspace 24, until the pressure plate 12 comes to bear against the opposing bearing surface 13. After this, the wedge bar 10 is moved in the direction of the wedge stop face 11 with the aid of the hydraulic piston-cylinder unit 15, and following contact with the wedge bar 10, is displaced on this wedge stop face 11 transversely to the longitudinal direction of the wedge bar until the pressure plate 12 bears tight against the opposing bearing surface 13, whereupon, due to the inclination of the individual parts, the coupling part 1 is displaced along the opposing bearing surface 13 in such a way in the direction of the hook 9 that the transverse bar 8 is mounted in a play-free manner in the hook 9. The hydraulic piston-cylinder unit is then fixed in this position and the pressure maintained until such time as decoupling is due to take place.

When the work activity is completed, the work tool is set up on the ground, after which the hydraulic piston-cylinder unit 15 is pressurized in the direction of an extension, the effect of which is that the wedge bar 10 is now moved away from the wedge stop face 11, to be precise to the point where the wedge bar 10 ends up in the region of the free interspace 24. After this, through pivoting of the coupling part 1 about the transverse bar 8 in the hook 9 of the hook connection 3, the coupling part 1 can be released from the coupling part 2 in the region of the bearing surfaces 5 and of the wedge connection 4 and the transverse bar 8 can then be moved out of the hook 9 of the hook connection 3.

If, in the illustrative embodiment according to FIGS. 9 and 10, the work tool is intended to be coupled to the excavator boom such that it is differently directed, i.e. twisted by 180°, then the coupling is realized via the hooks 9', the wedge stop faces 11' and the opposing bearing surface 13', in which case the hooks 9, the wedge stop faces 11 and the opposing bearing surface 13 are redundant.

I claim:

1. A quick-change coupling for attaching work tools to an excavator boom, comprising:

a first coupling body part disposable on the work tool and a second coupling body part disposable on the excavator boom, said first and second coupling body parts being mutually securable by a hook connection and a wedge lock with common bearing surfaces formed on said first and second coupling body parts, respectively, and being substantially in contact when said first and second body parts are coupled to one another, and said first coupling body part having formed therein a recess for the hook connection and a recess for the wedge connection; and said first coupling body part including at least two coupling plates respectively disposable on the work tool parallel to and laterally on both sides of a longitudinal center plane of the work tool, said coupling plates being formed with mutually congruent recesses for the hook connection, recesses for the wedge connection, and said bearing surfaces of said first coupling body part formed in said recesses for the wedge connection and configured to bear against said bearing surfaces of said second coupling body part when said wedge lock is being closed so that the work tool can be attached to the excavator boom.

2. The quick-change coupling according to claim 1, wherein said second coupling body part includes support plates disposable on the excavator boom, on both sides of a plane of inflexion of the boom in a state coupled to said coupling plates and running parallel to said coupling plates, for counterparts forming the hook connection and the wedge connection to be hung or secured in said recesses formed in said coupling plates.

3. The quick-change coupling according to claim 2, which comprises a wedge bar extending transversely to said support plates, said wedge bar forming a counterpart for said wedge connection and being guided in a track rising obliquely away from the work tool.

4. The quick-change coupling according to claim 3, wherein said wedge bar passes through said support plates and protrudes from outer sides of said support plates facing away from the excavator boom, and wherein a wedge profile is provided on both sides of each of said support plates.

5. The quick-change coupling according to claim 1, which comprises a transverse bar forming a counterpart for said hook connection, said transverse bar passing through said support plates and protruding from outer sides of said support plates facing away from the excavator boom.

6. The quick-change coupling according to claim 3, which comprises a hydraulic piston-cylinder unit for actuating said wedge bar, said hydraulic piston-cylinder unit being fully extended when said wedge connection is unlocked.

7. The quick-change coupling according to claim 1, wherein said congruent recesses in said coupling plates are configured symmetrically in relation to a vertical center plane transversely to a plane of said plates.

8. The quick-change coupling according to claim 1, wherein each of said coupling plates is disposable in a pair of coupling plates respectively disposed laterally of a longitudinal center plane of the work tool, each pair of coupling plates forming an interspace therebetween for receiving support plates disposable on the excavator boom.

9. The quick-change coupling according to claim 6, which comprises a transverse bar forming a counterpart for said hook connection, said transverse bar passing through said support plates and protruding from outer sides of said support plates facing away from the excavator boom, and said hydraulic piston-cylinder unit having an end facing away from said wedge bar supported against said transverse bar belonging to said hook connection.

10. The quick-change coupling according to claim 9, which comprises cranked links mounted to said transverse bar for supporting said hydraulic piston-cylinder unit in a direction of fastening of the excavator boom, said cranked links being prevented from pivoting relative to said support plates.

11. The quick-change coupling according to claim 6, wherein said hydraulic piston-cylinder unit and said wedge bar are connected with play.

12. A quick-change coupling, work tool, and excavator boom, comprising:

a work tool having mounted thereon a first coupling body part and defining a longitudinal center plane;

an excavator boom having mounted thereon a second coupling body part, said second coupling body part including a transverse bar for a hook connection, a wedge element for a wedge lock between said first and second coupling body parts, and a support plate;

said first coupling body part on said work tool including at least two coupling plates disposed on said work tool parallel to and laterally on both sides of said longitudinal center plane, said coupling plates being formed with mutually congruent recesses for receiving said transverse bar to form the hook connection and for receiving said wedge element for the wedge lock between said first and second coupling body parts, and said coupling plates being formed with bearing surfaces in said recess for receiving said wedge element configured to bear against said support plate on said second coupling body part when said work tool is coupled to said excavator boom and said work tool in subjected to a force towards said excavator boom.

13. The quick-change coupling according to claim 12, which comprises a hydraulic piston-cylinder unit for actuating said wedge bar, said hydraulic piston-cylinder unit being fully extended when said wedge connection is unlocked.

14. The quick-change coupling according to claim 12, wherein said congruent recesses in said coupling plates are configured symmetrically in relation to a vertical center plane transversely to a plane of said plates.

* * * * *